US009723882B2

(12) United States Patent
Reuben

(10) Patent No.: US 9,723,882 B2
(45) Date of Patent: Aug. 8, 2017

(54) ARTICLE OF APPAREL CONVERTIBLE TO A SLEEPING BAG

(71) Applicant: Ronie Reuben, Town of Mount Royal (CA)

(72) Inventor: Ronie Reuben, Town of Mount Royal (CA)

( * ) Notice: Subject to any disclaimer, the term of this patent is extended or adjusted under 35 U.S.C. 154(b) by 0 days.

(21) Appl. No.: 14/757,228

(22) Filed: Dec. 9, 2015

(65) Prior Publication Data

US 2016/0165975 A1 Jun. 16, 2016

(30) Foreign Application Priority Data

Dec. 12, 2014 (CA) ..... 2874644

(51) Int. Cl.

| | |
|---|---|
| ***A41D 15/04*** | (2006.01) |
| ***A41D 3/00*** | (2006.01) |
| ***A41D 15/00*** | (2006.01) |
| ***A47G 9/08*** | (2006.01) |

(52) U.S. Cl.

CPC ..... *A41D 15/04* (2013.01); *A41D 3/00* (2013.01); *A41D 15/002* (2013.01); *A47G 9/086* (2013.01); *A41D 2200/20* (2013.01)

(58) Field of Classification Search

CPC ..... A41D 15/04

USPC ..... 2/69.5, 108, 70, 72, 86, 212, 213; 5/413 R

See application file for complete search history.

(56) References Cited

U.S. PATENT DOCUMENTS

| | | | | |
|---|---|---|---|---|
| 4,347,629 | A * | 9/1982 | Itoi | A41D 3/00 2/108 |
| 5,815,833 | A * | 10/1998 | Kuo | A41D 15/04 2/69.5 |
| 6,334,221 | B1 * | 1/2002 | Hope | A41D 10/00 2/69 |
| 2014/0366239 | A1 * | 12/2014 | Biller | A41D 3/00 2/69.5 |

* cited by examiner

*Primary Examiner* — Katherine Moran
(74) *Attorney, Agent, or Firm* — Houle Patent Agency Inc.

(57) ABSTRACT

An article of apparel convertible to a sleeping bag is comprised of a jacket having a body portion and a pair of detachable sleeves removably secured to respective shoulder portions of the portion by attachments. The body portion has an extendable waist section. The detachable sleeves have an elongated detachable closure extending longitudinally thereof to deploy the sleeve lengthwise whereby the pair of sleeves can be interconnected together to form a tubular leg pouch. The sleeves also have gussets extending from wrist bands thereof to expand when deployed. The top attachment zippers of the sleeves permit attachment of the tubular leg pouch to zipper fasteners in a lower edge of the extendable waist portion to form the sleeping bag.

13 Claims, 4 Drawing Sheets

ARTICLE OF APPAREL CONVERTIBLE TO A SLEEPING BAG

TECHNICAL FIELD

The present invention relates to an article of apparel convertible to a sleeping bag and wherein the article of apparel comprises a jacket having detachable sleeves, which sleeves are interconnectible together to form a tubular leg pouch which is secured to the jacket to form a portion of a sleeping bag.

BACKGROUND ART

It is known to convert an article of apparel such as a jacket into a sleeping bag. Examples of these can be found in U.S. Pat. Nos. 4,575,876, 5,560,043 and 6,061,831. In all of these patents, a major portion of the sleeping bag is a separate article concealed within the jacket. This makes for a very bulky and heavier jacket. Also, such sleeping bags are not well insulated.

There is a need to provide a jacket wherein a major portion of the sleeping bag can be fabricated by interconnecting usual jacket parts together without having to carry large portions of a sleeping bag concealed within the jacket.

There is also a need to provide an article of apparel which is comprised of a jacket convertible into a sleeping bag and wherein the sleeping bag is extendable for the comfort of wearer persons of different sizes.

SUMMARY OF INVENTION

It is a feature of the present invention to provide an article of apparel which comprises a jacket which is thermally insulated with down feathers and which is convertible into a sleeping bag by the use of the sleeves of the jacket and small foot pouch which is concealed within the jacket and is comfortable to the wearer person.

According to the above feature and needs, from a broad aspect, the present invention provides an article of apparel convertible to a sleeping bag. The article of apparel comprises a jacket having a body portion and a pair of detachable sleeves removably secured to respective shoulder portions of the body portion by an attachment means. The sleeves have expandable means extending from a wrist opening thereof and extends longitudinally along a lower section of the sleeves. The body portion has an extendable waist section. A hood is secured to the body portion. Each of the detachable sleeves have an elongated detachable closure means extending longitudinally thereof to deploy the sleeve whereby the pair of sleeves can be interconnected together by interconnecting the elongated detachable closure means of one of the sleeves to the detachable closure means of the other of the sleeves to form a tubular leg pouch. The attachment means of the sleeves permits attachment of the tubular leg pouch to a fastening means in a lower edge of the extendable waist portion.

BRIEF DESCRIPTION OF DRAWINGS

A preferred embodiment of the present invention will now be described with reference to the accompanying drawings in which.

DESCRIPTION OF PREFERRED EMBODIMENTS

Figure 9:
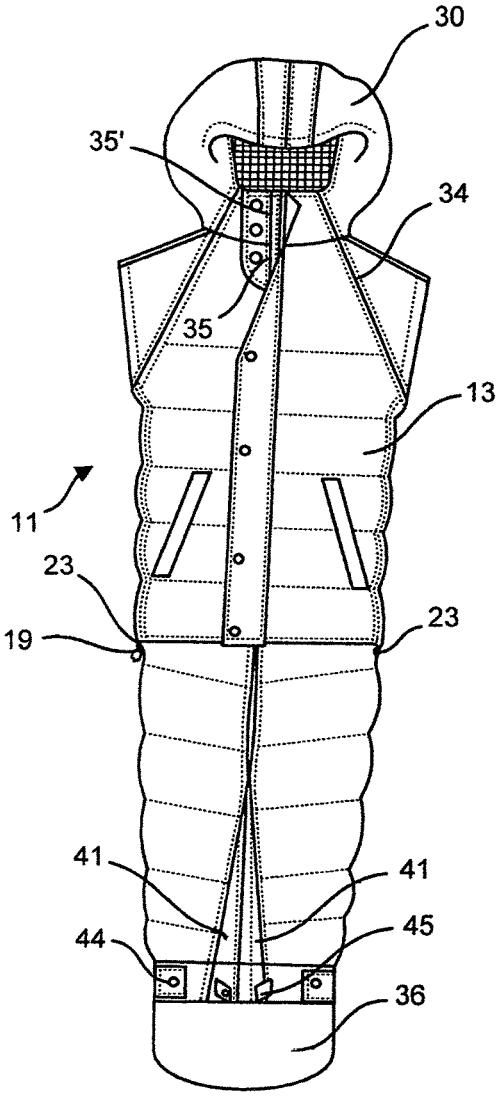
FIG. 9 is a front view of the jacket when converted into a sleeping bag.
Figure 10:
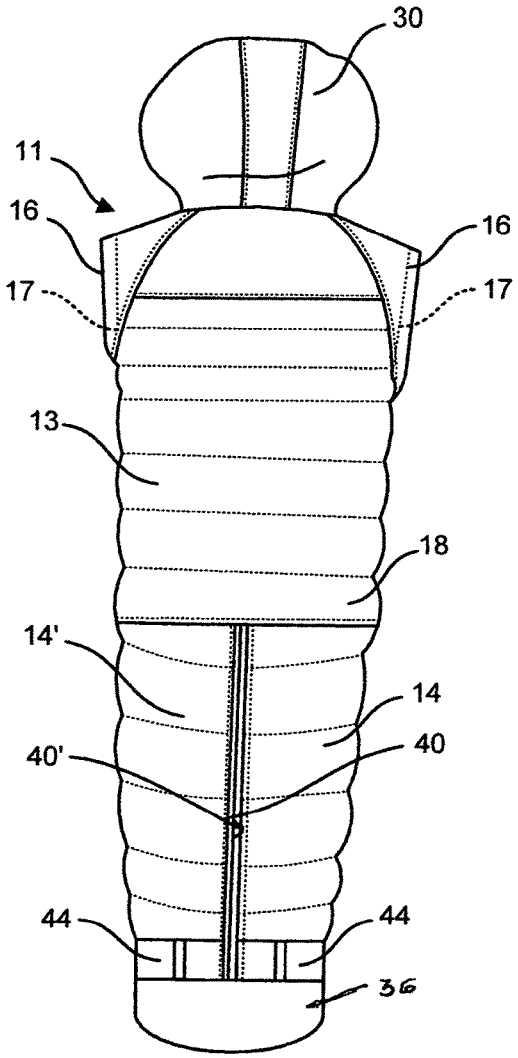
FIG. 10 is a rear view of FIG. 9 showing the jacket portion in a fully extended condition and illustrating the entire length of the sleeping bag in inches.

Referring now to the drawings and more particularly to FIGS. 1 to 6, there is shown generally at 10 the article of apparel of the present invention which is convertible into a sleeping bag 11, as shown in FIGS. 9 and 10. The article of apparel 10 comprises a jacket 12 which has a body portion 13 and a pair of detachable sleeves 14 and 14'. The detachable sleeves 14 and 14' are removably secured to a respective shoulder portion 15 of the jacket about shoulder portion openings 16 as shown on the left side of FIG. 1 wherein the sleeve 14' is detached from the body portion 13. As hereinshown, the attachment means to attach the sleeves to the openings 16 is provided by a zipper 17. The zipper 17 is adapted with sufficient pull tabs to secure itself to close the opening 16 of the shoulder portions when forming the sleeping bag 11.

Figure 1:
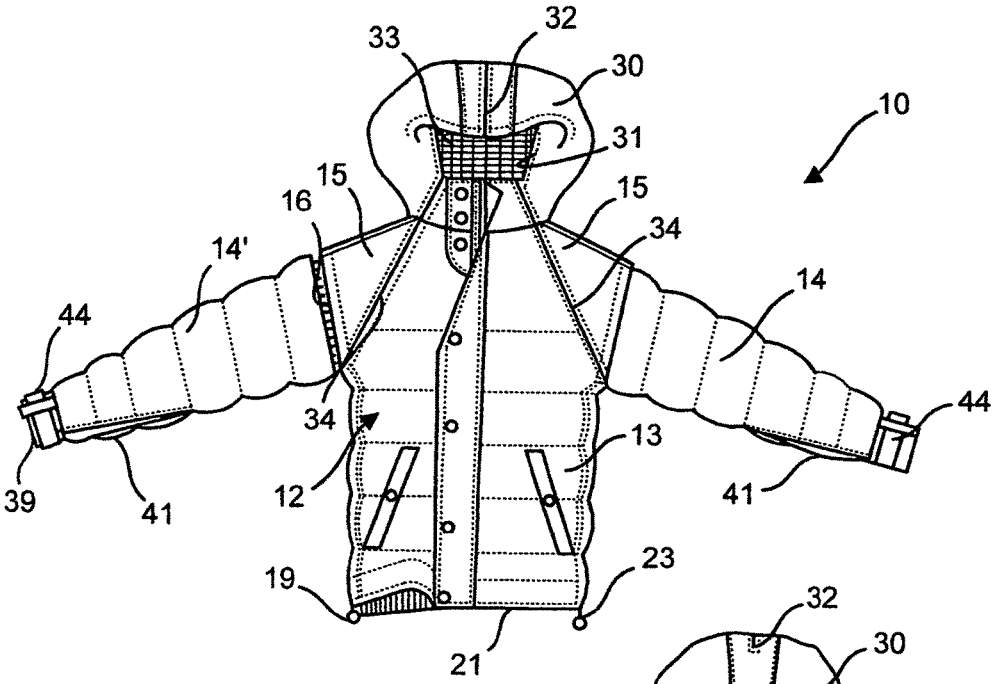
FIG. 1 is a front view of an article of apparel constructed in accordance with the present invention and convertible to a sleeping bag and wherein the article of apparel is comprised of a jacket having a hood secured thereto.
Figure 2:
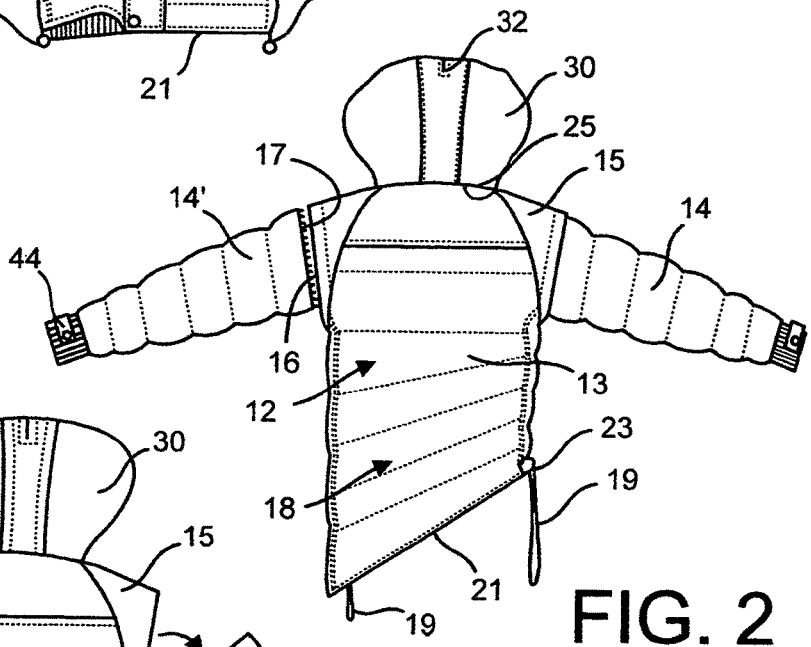
FIG. 2 is a rear view of FIG. 1 but showing the jacket partly extended at a waist portion thereof.
Figure 3:
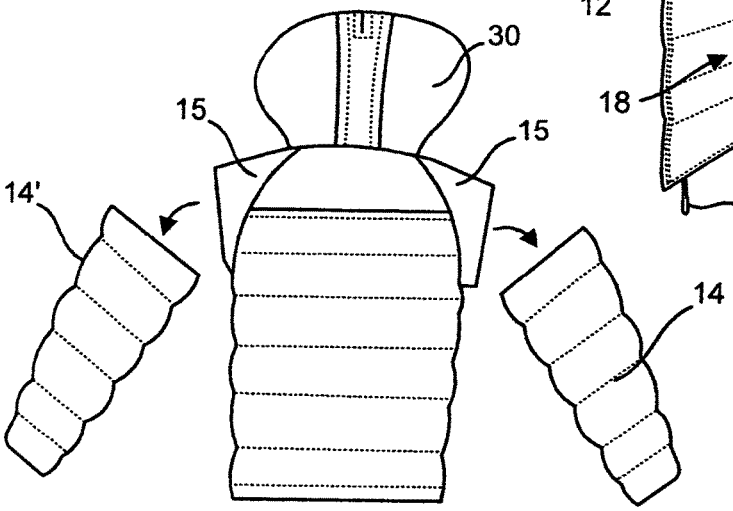
FIG. 3 is a further rear view of FIG. 1 but illustrating that the sleeves are detachable therefrom.
Figure 6:
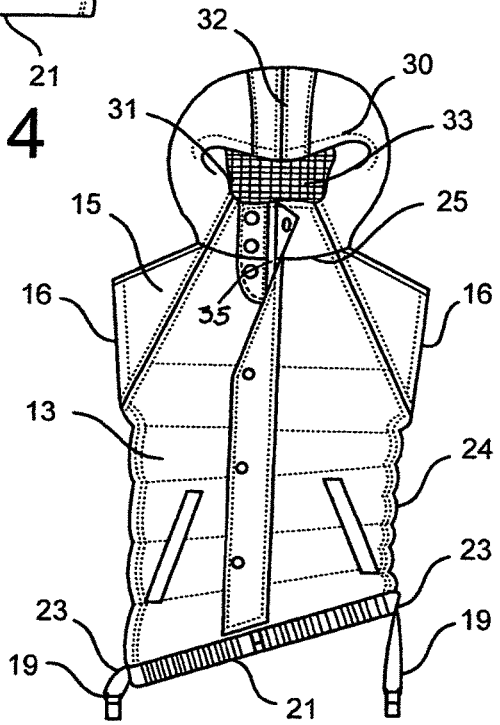
FIG. 6 is a front view of the jacket showing the sleeves removed and illustrating the function of the draw cords to shorten or lengthen the jacket.

As shown in FIGS. 1 to 6, the body portion 13 of the jacket 12 has an extendable waist section 18 which is adjustable in length as shown in FIGS. 2 and 6 by the use of draw-cords 19 which are each disposed in a respective one of concealed passageways or channels 20 formed on opposed sides of the body portion 13 inside the external fabric material. The channels 20 extend from the lower edge 21 of the jacket, or of the extendable waist portion 18, and terminates below the sleeve openings 16 where the cords are secured. The draw-cords 19 extend out of the lower edge 21 and extends through a displaceable slide member 22 which is a slide member of a type well known in the art and which has a cord arresting means in the form of a spring-loaded pin which, when depressed, permits the slide member to be displaced on the draw-cord and when released immovably secures itself to the draw-cord. As the slider is pushed up into the lower edge 21 of the fabric in the extendable waist section, for example as shown in FIGS. 2 and 6, the fabric is compressed or pleated, as shown by reference numeral 24 in FIG. 6, whereby to shorten the length of the jacket. In the embodiment as herein illustrated, the jacket can be shortened from the neck portion 25 to the lower edge 21 to compress it to 27 inches in length and when extended that length is increased up to 42 inches. Accordingly, there is a 15 inch adjustment in length in that extendable waist section 18 and consequently in the length of the sleeping bag as described below. Accordingly, the slide member 22 can clamp and unclamp the draw-cord which extends therethrough whereby to compress and release compressed fabric in the extendable waist section 18 of the jacket.

Figure 4:
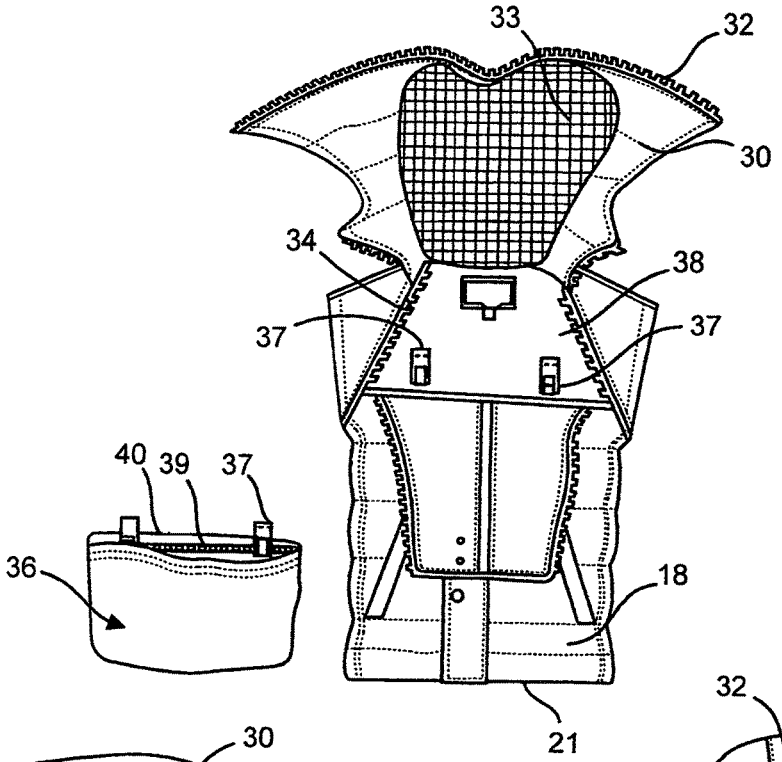
FIG. 4 is a front view of the jacket with the sleeves having been removed and the hood opened to expose an inner micro-mesh hood secured therein and further illustrating a foot pouch attached to the inner lining of the jacket and with the top part of the jacket being opened.
Figure 5:
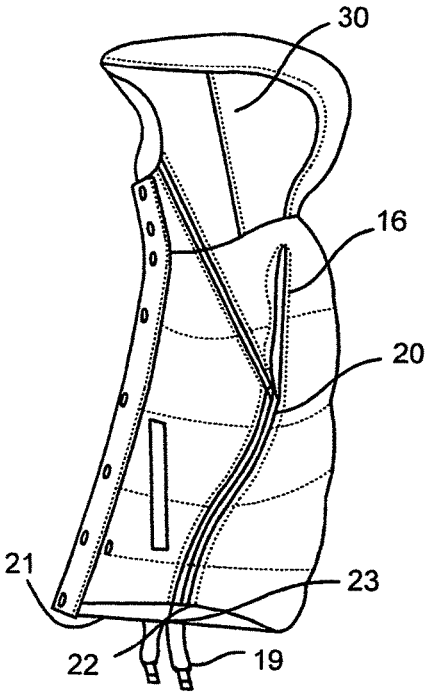
FIG. 5 is a side view showing the construction of the draw cords assembly whereby to extend or shorten the length of the jacket.

As hereinshown, the jacket is also provided with a hood 30 which has a face opening 31. A zip fastener 32 extends centrally of the hood on the top part thereof from the face opening 31 and terminates on top of the hood as can be seen from FIG. 2. An inner micro-mesh hood 33, as better seen in FIG. 4, is secured within the hood 30 and displaced to be positioned over the head of a wearer person and extending over the face of the wearer person whereby to protect the face against bugs while permitting the wearer person to breath through the mesh. A zipper 35 also provides for a secured central opening of the body portion 13 of the jacket. Also, as shown in FIG. 4, additional zippers 34 permit the jacket to be open in the upper top area thereof for access to the inside of a jacket where a foot pouch 36 is stored by detachable securement to connection means in the form of VELCRO (hook and loop) tabs 37 secured to the inner lining 38 of the jacket in the back wall thereof. Connecting means in the form of VELCRO (hook and loop) strips 39 are also provided about the foot pouch on the inner face thereof adjacent the top opening 40 of the foot pouch. This foot pouch forms the bottom end of the sleeping bag 11, as shown in FIG. 9.

Having described the component parts of the jacket 12 and its single small accessory foot pouch, we will now describe the assembly of the component parts of the jacket to form the sleeping bag 11 as illustrated in FIGS. 9 and 10.

Figure 7:
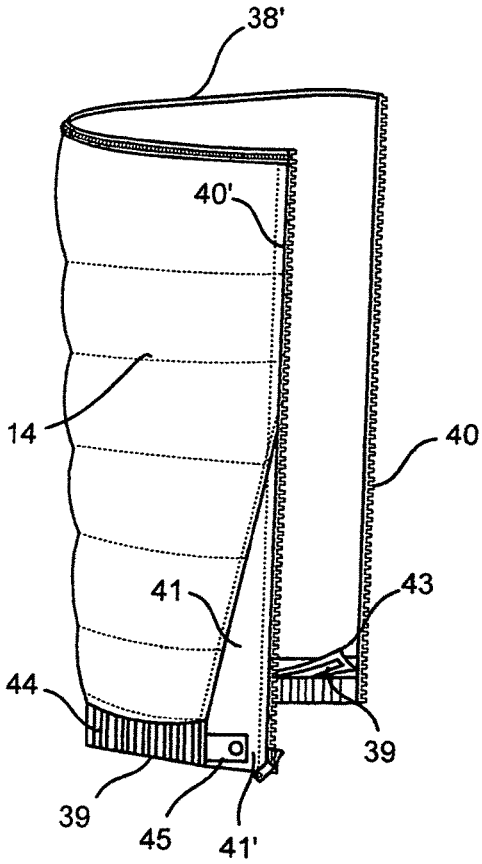
FIG. 7 is a perspective view showing the sleeves detached from the jacket.
Figure 8:
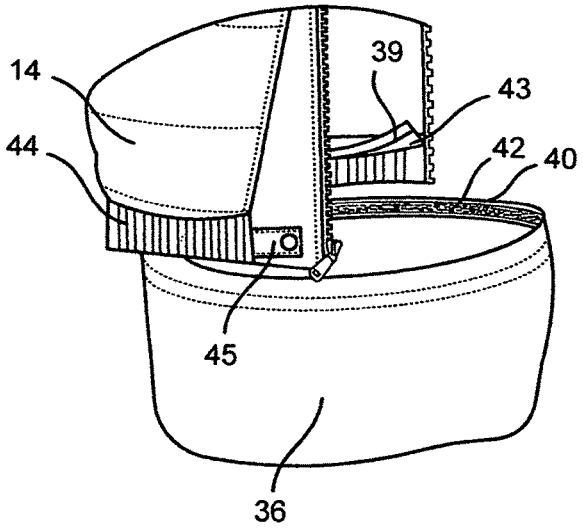
FIG. 8 is a fragmented view showing a lower portion of the sleeve and how it is attached to the foot pouch.

As shown in FIG. 7, the detachable sleeves 14 are each provided with an elongated detachable closure means in the form of zipper closures 40 extending longitudinally thereof whereby to deploy the sleeve lengthwise as shown in FIG. 7. As also shown in FIG. 7, the sleeves are each provided with expandable means in the form of a gusset fabric piece 41 having a wide section 41' at a wrist opening 39 of the sleeves 14 and 14' and tapering inwardly to an elbow portion 41" of the sleeve whereby to expand the width of the sleeve in the wrist opening portion 39 thereof. Both deployed sleeves are attached to one another by securing its longitudinal zipper sections 40 and 40' whereby the two interconnected sleeves form a tubular leg cylinder portion which is then secured to the foot pouch 36, as shown in FIG. 10 by the use of the VELCRO (hook and loop) strips 39 secured on a fabric flap 43 which is attached to the inner lining 38' of the sleeves adjacent the wrist band 44 of the sleeves 14 and 14'. These VELCRO (hook and loop) strips 39 when exposed are mated with the VELCRO (hook and loop) strips 42 disposed inside the foot pouch 36 adjacent the open end 40 thereof. Accordingly, the two sleeves and the foot pouch form a tubular leg pouch as shown in FIGS. 9 and 10. The tabs 45 adjacent the wrist bands 44 of the sleeve are to maintain the gusset material 41 pleated and concealed under the sleeve as better illustrated in FIG. 1.

Figure 11:
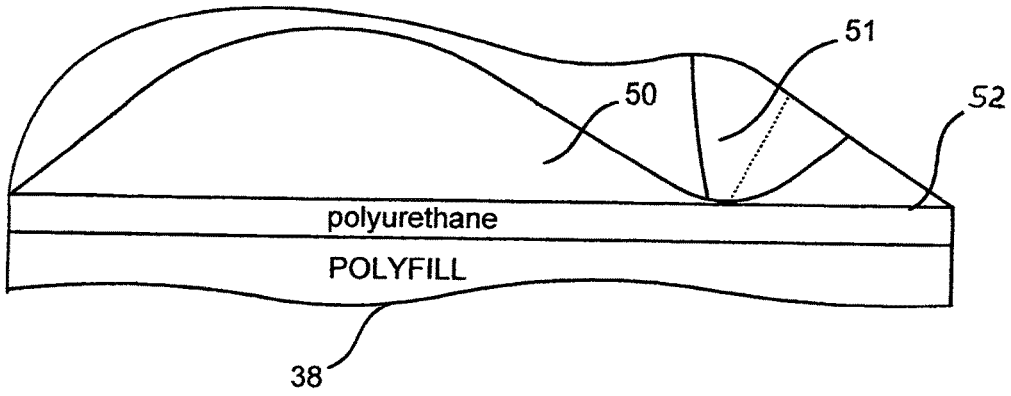
FIG. 11 is a fragmented, partly sectioned view showing the construction of the down insulation and fabric composition of the jacket.

As shown in FIG. 11, the article of apparel is fabricated with down feathers 50 insulation held captive between the outer fabric material 51 and a polyurethane sheet 52 which is ⅛ inch in thickness. On the other side of the polyurethane sheet 52 a thick polyfilm material is attached thereto and forms the inner lining 38 of the jacket.

Referring again to FIGS. 9 and 10, the sleeping bag 11 forms a tight secured enclosure for a wearer person and the person can enter into the sleeping bag by unzipping the central vertical zipper 35 and the side zippers 34 which have double-sided pull tabs (not shown) accessible from inside the sleeping bag. These zippers 34 extend into the hood 30. Also, the pull tab 35' of the central zipper is a double-sided pull tab also accessible from inside the sleeping bag permitting the user person to enter and easily exit the sleeping bag. After use, the component parts of the sleeping bag are easily detached and re-attached to form the jacket 12, shown in FIG. 1. The inner micro-mesh hood is simply pushed back in the back portion of the hood 30 when not in use.

It is within the ambit of the present invention to cover any obvious modifications of a preferred embodiment described herein, provided such modifications fall within the scope of the appended claims.

I claim:

1. An article of apparel convertible to a sleeping bag, said article of apparel comprising a jacket having a body portion and a pair of detachable sleeves removably secured to respective shoulder portions of said body portion by an attachment means, said sleeves having expandable means extending from a wrist opening thereof and longitudinally along a lower section of said sleeves, said body portion having an extendable waist section, a hood secured to said body portion, each said detachable sleeves having an elongated detachable closure means extending longitudinally thereof to deploy said sleeve whereby said pair of sleeves can be interconnected together by interconnecting said elongated detachable closure means of one of said sleeves to the detachable closure means of the other of said sleeves to form a tubular leg pouch, said attachment means of said sleeves permitting attachment of said tubular leg pouch to a fastening means in a lower edge of said extendable waist portion.

2. An article of apparel as claimed in claim 1 wherein there is further provided a foot pouch, said foot pouch having connecting means for detachable securement to complimentary connecting means provided in a lower edge of said tubular leg pouch.

3. An article of apparel as claimed in claim 2 wherein said foot pouch has detachable attachment to complimentary securement elements concealed inside said body portion of said jacket when not in use.

4. An article of apparel as claimed in claim 2 wherein said connecting means is constituted by one or more hook and loop strips secured on a fabric flap attached to an inner lining of said sleeves adjacent a wrist opening of said sleeves, said hook and loop strips being securable to further hook and loop strips secured about an opening of said tubular leg pouch.

5. An article of apparel as claimed in claim 1 wherein said jacket is a thermally insulated jacket.

6. An article of apparel as claimed in claim 5 wherein said jacket is thermally insulated with down feathers.

7. An article of apparel as claimed in claim 1 wherein said hood is provided with a face opening, an inner micro-mesh hood secured within said hood and displaceable to be positioned over the head of a wearer person and to extend over said face opening.

8. An article of apparel as claimed in claim 1 wherein said extendable waist section is comprised by draw-cords each disposed in a concealed channel formed on opposed sides of said body portion and extending from said lower edge of said extendable waist portion and terminating below said sleeves, said draw-cords being secured in an upper end of respective ones of said channels and extending out of said lower edge, each said draw-cords extending through a displaceable slide member having cord arresting means adapted to abut against said lower end of said channel, said cord arresting means having actuable means to clamp and unclamp from said draw-cord whereby to compress and release compressed fabric of said body portion to lengthen or shorten said body portion and thereby lengthen or shorten said sleeping bag.

9. An article of apparel as claimed in claim 1 wherein said attachment means and elongated detachable closure means are zipper attachment means.

10. An article of apparel as claimed in claim 1 wherein said fastening means in said lower edge of said extendable waist portion is a zipper attachment means.

11. An article of apparel as claimed in claim 1 wherein said expandable means is comprised by a gusset fabric piece having a wide section at said wrist opening and tapering inwardly to an elbow portion of said sleeve whereby to form said tubular leg pouch with sufficient space for the comfort of the legs of a person sleeping in said sleeping bag.

12. An article of apparel as claimed in claim 11 wherein said gusset fabric is maintained pleated within said sleeve by an attachment tab secured to a wrist band about said wrist opening.

13. An article of apparel as claimed in claim 1 wherein said attachment means is a zipper attachment means having a pull tab secured in openings of said shoulder portions, said zipper attachment means being adapted to secure to said detachable sleeves and to itself to close said openings of said shoulder portions to form said sleeping bag.

* * * * *